US012351884B2

(12) United States Patent
So et al.

(10) Patent No.: US 12,351,884 B2
(45) Date of Patent: Jul. 8, 2025

(54) HIGH-STRENGTH ULTRA-THICK STEEL PLATE HAVING SUPERB IMPACT TOUGHNESS AT LOW-TEMPERATURES, AND METHOD FOR MANUFACTURING SAME

(71) Applicant: POSCO, Pohang-si (KR)

(72) Inventors: Tae-Il So, Gwangyang-si (KR); Sang-Deok Kang, Gwangyang-si (KR)

(73) Assignee: POSCO, Pohang-si (KR)

( * ) Notice: Subject to any disclaimer, the term of this patent is extended or adjusted under 35 U.S.C. 154(b) by 587 days.

(21) Appl. No.: 17/642,102

(22) PCT Filed: Sep. 10, 2020

(86) PCT No.: PCT/KR2020/012206

§ 371 (c)(1),
(2) Date: Mar. 10, 2022

(87) PCT Pub. No.: WO2021/054672

PCT Pub. Date: Mar. 25, 2021

(65) Prior Publication Data

US 2022/0364193 A1 Nov. 17, 2022

(30) Foreign Application Priority Data

Sep. 17, 2019 (KR) ..... 10-2019-0114345

(51) Int. Cl.
*C21D 8/02* (2006.01)
*C21D 9/46* (2006.01)
(Continued)

(52) U.S. Cl.
CPC ..... *C21D 8/0205* (2013.01); *C21D 8/0226* (2013.01); *C21D 8/0263* (2013.01);
(Continued)

(58) Field of Classification Search
CPC .. C21D 8/0205; C21D 8/0226; C21D 8/0263; C21D 9/46; C22C 38/001; C22C 38/02;
(Continued)

(56) References Cited

U.S. PATENT DOCUMENTS 10,351,937 B2 7/2019 Kawata et al.
2016/0010192 A1* 1/2016 Kitsuya ..... C21D 6/005 148/541
(Continued)

FOREIGN PATENT DOCUMENTS

CN 103717771 A 4/2014
CN 105008570 A 10/2015
(Continued)

OTHER PUBLICATIONS

JPH0827538A english translation (Year: 1996).*
(Continued)

*Primary Examiner* — Ricardo D Morales
(74) *Attorney, Agent, or Firm* — Morgan Lewis & Bockius LLP

(57) ABSTRACT

One aspect of the present invention is to provide a superior steel plate and a method for manufacturing same, the steel plate, as an ultra-thick steel plate, having high strength as well as superb impact toughness low-temperature, and excellent resistance to formation of cracks.

5 Claims, 1 Drawing Sheet

(51) Int. Cl.

| | |
|---|---|
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/44*** | (2006.01) |
| ***C22C 38/46*** | (2006.01) |
| ***C22C 38/54*** | (2006.01) |

(52) U.S. Cl.
CPC ..... *C21D 9/46* (2013.01); *C22C 38/001* (2013.01); *C22C 38/02* (2013.01); *C22C 38/04* (2013.01); *C22C 38/06* (2013.01); *C22C 38/44* (2013.01); *C22C 38/46* (2013.01); *C22C 38/54* (2013.01); *C21D 2211/002* (2013.01); *C21D 2211/008* (2013.01)

(58) Field of Classification Search
CPC ..... C22C 38/04; C22C 38/06; C22C 38/44; C22C 38/46; C22C 38/54
See application file for complete search history.

(56) References Cited

U.S. PATENT DOCUMENTS

| | | | |
|---|---|---|---|
| 2017/0044639 | A1 | 2/2017 | Kitsuya et al. |
| 2017/0088913 | A1 | 3/2017 | Kitsuya et al. |
| 2017/0369958 | A1 | 12/2017 | Kitsuya et al. |
| 2018/0073116 | A1 | 3/2018 | Zhao et al. |
| 2018/0155805 | A1 | 6/2018 | Kuronuma et al. |
| 2019/0024206 | A1 | 1/2019 | Kim |

FOREIGN PATENT DOCUMENTS

| | | | | | |
|---|---|---|---|---|---|
| CN | 108368595 | A | | 8/2018 | |
| EP | 2894235 | A1 | | 7/2015 | |
| EP | 2942414 | A1 | | 11/2015 | |
| EP | 3222744 | A1 | | 9/2017 | |
| EP | 3272899 | A1 | | 1/2018 | |
| EP | 3395998 | A1 | | 10/2018 | |
| EP | 3395999 | A1 | | 10/2018 | |
| JP | S50-159409 | A | | 12/1975 | |
| JP | S51-40325 | A | | 4/1976 | |
| JP | H04-285119 | A | | 10/1992 | |
| JP | H05-171343 | A | | 7/1993 | |
| JP | H0827538 | A | * | 1/1996 | ..... C22C 38/00 |
| JP | H10-265893 | A | | 10/1998 | |
| JP | 2001-59142 | A | | 3/2001 | |
| JP | 2012-172242 | A | | 9/2012 | |
| JP | 2014-29003 | A | | 2/2014 | |
| JP | 2017-186592 | A | | 10/2017 | |
| JP | 2018-176241 | A | | 11/2018 | |
| KR | 10-2013-0002173 | A | | 1/2013 | |
| KR | 10-2014-0098900 | A | | 8/2014 | |
| KR | 10-1546132 | B1 | | 8/2015 | |
| KR | 10-1623661 | B1 | | 5/2016 | |
| KR | 10-2016-0078675 | A | | 7/2016 | |
| KR | 10-2016-0079166 | A | | 7/2016 | |
| KR | 10-2016-0143732 | A | | 12/2016 | |
| KR | 10-2017-0030095 | A | | 3/2017 | |
| KR | 10-2017-0066612 | A | | 6/2017 | |
| WO | 2014/141697 | A1 | | 9/2014 | |
| WO | 2015/140846 | A1 | | 9/2015 | |
| WO | 2016/114146 | A1 | | 7/2016 | |

OTHER PUBLICATIONS

International Search Report dated Jan. 5, 2021 issued in International Patent Application No. PCT/KR2020/012206 (with English translation).
Chinese Office Action dated Jul. 27, 2022 issued in Chinese Patent Application No. 202080064258.1 (with English translation).
Extended European Search Report dated Sep. 20, 2022 issued in European Patent Application No. 20866228.8.
Office Action issued Jun. 20, 2023 for corresponding Japanese Patent Application No. 2022-517120.

* cited by examiner

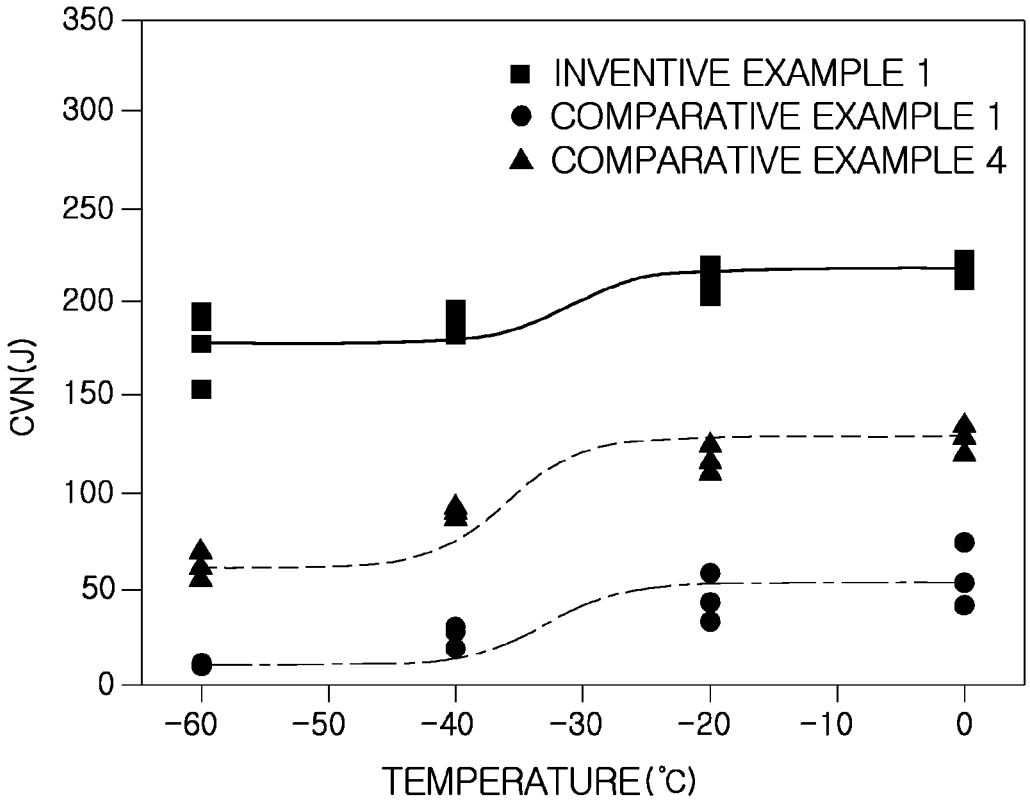
INVENTIVE EXAMPLE 1
COMPARATIVE EXAMPLE 1
COMPARATIVE EXAMPLE 4
CVN(J)
350
300
250
200
150
100
50
0
−60
−50
−40
−30
−20
−10
0
TEMPERATURE(℃)

HIGH-STRENGTH ULTRA-THICK STEEL PLATE HAVING SUPERB IMPACT TOUGHNESS AT LOW-TEMPERATURES, AND METHOD FOR MANUFACTURING SAME

CROSS-REFERENCE OF RELATED APPLICATIONS

This application is the U.S. National Phase under 35 U.S.C. § 371 of International Patent Application No. PCT/KR2020/012206, filed on Sep. 10, 2020, which in turn claims the benefit of Korean Application No. 10-2019-0114345, filed on Sep. 17, 2019, the entire disclosures of which applications are incorporated by reference herein.

TECHNICAL FIELD

The present disclosure relates to a steel plate which may be appropriately used for pressure vessels, marine structures, and the like, and more particularly, to a high-strength ultra-thick steel plate having excellent impact toughness at low temperature and a method for manufacturing the same.

BACKGROUND ART

In recent years, in line with the trend for larger structures such as marine structures and pressure vessels, demand for a high-strength ultra-thick steel plate has increased. In addition, as the use environment of such structures expands to extremely cold regions, excellent impact toughness at low temperature is required, and a steel plate to which severe processing is applied in the manufacturing of the structures is also required to have strain aging impact toughness at low temperature.

When a slab having a relatively reduced thickness is used in the manufacturing of an ultra-thick steel plate, sufficient pressing force may not be applied to a center portion in a thickness direction. In addition, depending on a difference in cooling rates, the type and the fraction of the microstructures in center and surface parts are different, to cause a difference in physical properties, resulting in difficulty in securing a uniform strength in the thickness direction.

A heavy/thick steel plate having a thickness up to 100 mm is generally manufactured using a slab having a thickness of 300 to 400 mm, but an ultra-thick steel plate having a thickness of more than 130 mm is required to use a slab having a thickness of 400 mm or more due to a limitation in a pressing ratio (3:1).

Meanwhile, in order to manufacture a high-strength ultra-thick steel plate, a method of adding an appropriate amount of elements for improving hardenability, such as Mn, Cr, and Mo, to promote improvement of quenching properties and increase strength of a steel, is mainly used. In this case, a large amount of structures such as martensite or bainite are produced inside the steel plate at low temperature by a cooling treatment such as a tempering treatment of a steel, thereby improving the strength of a steel.

However, when elements for hardenability as such are added in an excessive amount, a carbon equivalent (Ceq) is increased to raise a preheating temperature before welding or cracking, and thus, it is necessary to control alloy components so that the carbon equivalent is not exceeded.

As another method, precipitate elements such as Ti and Nb are added to promote improvements of strength by precipitation strengthening. However, when such elements are added in an excessive amount, coarse precipitates such as TiNbC are formed to decrease impact toughness of a steel at low temperature.

Patent Document 1 discloses that in order to implement the high strength of the ultra-thick steel plate, a forged slab obtained using a steel ingot containing various components is reheated and homogenized, the homogenized slab is subject to a hot rolling-quenching and tempering heat treatment, thereby obtaining a hot rolled steel sheet having high strength and high toughness.

However, in this technology, a large amount of nickel, which is relatively expensive, may be added to significantly lower economic feasibility, and from the fact that copper (Cu) is added together with niobium (Nb), it is recognized that the sensitivity of the steel for crack occurrence is not considered.

Therefore, the development of an ultra-thick steel plate having excellent impact toughness at low temperature as well as high strength so that it is appropriate for large structures such as marine structures and pressure vessels, and having excellent resistance to crack occurrence is demanded.

(Patent Document 1) Korean Patent Registration Publication No. 10-1623661

DISCLOSURE

Technical Problem

An aspect of the present disclosure is to provide an ultra-thick steel plate having excellent impact toughness at low temperature as well as high strength and excellent resistance to crack occurrence, and a method for manufacturing the same.

An object of the present disclosure is not limited to the above description. The object of the present disclosure will be understood from the entire content of the present specification, and a person skilled in the art to which the present disclosure pertains will understand an additional object of the present disclosure without difficulty.

Technical Solution

According to an aspect of the present disclosure, a high-strength ultra-thick steel plate having excellent impact toughness at low temperature includes, by weight: 0.11 to 0.18% of carbon (C), 0.1 to 0.5% of silicon (Si), 0.3 to 1.8% of manganese (Mn), 0.01% or less of phosphorus (P), 0.01% or less of sulfur (S), 0.01 to 0.1% of aluminum (Al), 0.01% or less (including 0%) of niobium (Nb), 0.2 to 1.5% of chromium (Cr), 1.0 to 2.5% of nickel (Ni), 0.25% or less (including 0%) of copper (Cu), 0.25 to 0.80% of molybdenum (Mo), 0.01 to 0.1% of vanadium (V), 0.003% or less (including 0%) of titanium (Ti), 0.001 to 0.003% of boron (B), and 0.002 to 0.01% of nitrogen (N), with a balance of Fe and unavoidable impurities, wherein a Ceq value represented by the following Relation 1 is more than 0.5 and less than 0.7, a component relationship among C, Mn, Cr, Mo, and V satisfies the following Relation 2, a component relationship among Ti, Nb, Cu, Ni, and N satisfies the following Relation 3, and the steel plate has a thickness of 130 mm or more and 350 mm or less:

$$Ceq=C+Mn/6+(Cr+Mo+V)/5+(Cu+Ni)/15 \quad \text{[Relation 1]}$$

$$1.5<C+Mn+Cr+Mo+V<2.5 \quad \text{[Relation 2]}$$

$$[(Ti+Nb)/3.5N+(Cu/Ni)]<1 \quad \text{[Relation 3]}$$

wherein each element refers to a content by weight of the element.

According to another aspect of the present disclosure, a method for manufacturing a high-strength ultra-thick steel plate having excellent impact toughness at low temperature includes: preparing a steel slab satisfying the alloy components described above and Relations 1 to 3; heating the steel slab at a temperature within a range of 1100 to 1200° C.; roughly rolling the heated steel slab at a temperature within a range of 1050° C. or higher; after the rough rolling, performing finish hot rolling at a temperature equivalent to or higher than Ar3 to manufacture a hot rolled steel sheet; air cooling the hot rolled steel sheet to room temperature; reheating the air cooled hot rolled steel sheet to a temperature equivalent to or higher than Ac3 to perform a heat treatment for (1.9 t+30) minutes or more (wherein t is a thickness (mm) of the steel) and then water cooling the steel to room temperature; and after the heat treatment, subjecting the water cooled hot rolled steel sheet to a tempering heat treatment at a temperature within a range of 550 to 700° C. for (2.3 t+30) minutes or more (wherein t is a thickness (mm) of the steel) and then air cooling the steel to room temperature.

Advantageous Effects

As set forth above, according to an exemplary embodiment in the present disclosure, an ultra-thick steel plate having uniform strength and impact toughness at low temperature over the entire thickness of the steel plate may be provided.

In addition, the steel plate of the present disclosure also has excellent impact toughness at low temperature of a weld heat affected zone formed after welding, and thus, may be appropriately applied to large structures, and the like.

DESCRIPTION OF DRAWINGS

FIG. 1 shows results of measuring impact toughness at each temperature of comparative examples and inventive examples of an exemplary embodiment in the present disclosure.

BEST MODE FOR INVENTION

As structures such as marine structures and pressure vessels become larger, the present inventors recognized that the development of a method for securing physical properties required of the materials is needed.

In particular, for an ultra-thick steel plate having a certain thickness or more, a method for securing excellent impact toughness at low temperature with high strength, and resistance to crack occurrence was intensively studied. As a result, it was confirmed that a component composition and a relationship between some components is controlled in an alloy design and also manufacturing conditions are optimized, thereby providing an ultra-thick steel plate having target physical properties, and thus, the present disclosure was completed.

Hereinafter, the present disclosure will be described in detail.

The high-strength ultra-thick steel plate having excellent impact toughness at low temperature according to an exemplary embodiment in the present disclosure may include, by weight: 0.11 to 0.18% of carbon (C), 0.1 to 0.5% of silicon (Si), 0.3 to 1.8% of manganese (Mn), 0.01% or less of phosphorus (P), 0.01% or less of sulfur (S), 0.01 to 0.1% of aluminum (Al), 0.01% or less (including 0%) of niobium (Nb), 0.2 to 1.5% of chromium (Cr), 1.0 to 2.5% of nickel (Ni), 0.25% or less (including 0%) of copper (Cu), 0.25 to 0.80% of molybdenum (Mo), 0.01 to 0.1% of vanadium (V), 0.003% or less (including 0%) of titanium (Ti), 0.001 to 0.003% of boron (B), and 0.002 to 0.01% of nitrogen (N).

Hereinafter, the reason that the alloy composition of the steel plate provided in the present disclosure is limited as described above will be described in detail.

Meanwhile, unless otherwise particularly stated in the present disclosure, the content of each element is by weight and the ratios of the structure are by area.

Carbon (C): 0.11 to 0.18%

Carbon (C) is an element effective for improving the strength of a steel. In order to sufficiently obtain the effect, C may be included at 0.11% or more. However, when the content is more than 0.18%, the impact toughness at low temperature of a parent metal and a weld zone is greatly deteriorated.

Therefore, C may be included at 0.11 to 0.18%, and more favorably 0.17% or less, or 0.15% or less.

Silicon (Si): 0.1 to 0.5%

Silicon (Si) is used as a deoxidizer, and also an element favorable to improve strength and toughness of a steel. In order to sufficiently obtain the effect, Si may be included at 0.1% or more. However, when the content is more than 0.5%, the weldability and toughness at low temperature of the steel may be deteriorated.

Therefore, Si may be included at 0.1 to 0.5%.

Manganese (Mn): 0.3 to 1.8%

Manganese (Mn) is an element favorable to improve the strength of a steel by a solid solution strengthening effect. In order to efficiently obtain the effect, Mn may be included at 0.3% or more. However, when the content is more than 1.8%, sulfur (S) in the steel is bonded to form MnS, thereby greatly deteriorating an elongation at room temperature and toughness at low temperature.

Therefore, Mn may be included at 0.3 to 1.8%, and more favorably at 0.4 to 1.7%.

Phosphorus (P): 0.01% or Less

Though phosphorus (P) is an element favorable to improve the strength of steel and secure corrosion resistance, it may greatly deteriorate impact toughness of the steel, and thus, it is preferred to limit the content as low as possible.

In the present disclosure, there is no difficulty in securing targeted physical properties even when P is included at 0.01% or less, and thus, the content of P may be limited to 0.01% or less. However, considering the unavoidably added level, 0% may be excluded.

Sulfur (S): 0.01% or Less

Sulfur (S) is an element which is bonded to Mn in a steel to form MnS and the like, thereby greatly deteriorating the impact toughness of a steel. Therefore, it is favorable that the content of S is limited as low as possible.

In the present disclosure, there is no difficulty in securing targeted physical properties even when S is included at 0.01% or less, and thus, the content of S may be limited to 0.01% or less. However, considering the unavoidably added level, 0% may be excluded.

Aluminum (Al): 0.01 to 0.1%

Aluminum (Al) is an element which may deoxidize molten steel inexpensively. In addition, Al is bonded to N in the steel to form AlN precipitates to suppress formation of BN, and thus, is favorable to maximize the effect of boron (B).

In order to sufficiently obtain the effect described above, Al may be included at 0.01% or more, but when the content is excessive and more than 0.1%, nozzle blocking is caused in continuous casting, which is thus not preferred.

Therefore, Al may be included at 0.01 to 0.1%.

Niobium (Nb): 0.01% or Less (Including 0%)

Niobium (Nb) is precipitated in the form of NbC or Nb (C, N) and greatly improves the strength of a parent metal and a weld zone, and Nb which is solid-solubilized at the time of reheating to a high temperature suppresses the recrystallization of austenite and the transformation of ferrite or bainite, thereby obtaining a structure refining effect. Besides, Nb increases the stability of austenite at the time of cooling after rolling to promote production of a hard phase such as martensite or bainite even at a low cooling rate, and thus, is useful for securing the strength of a parent metal.

However, Nb is an expensive element, and when it is excessively added with titanium (Ti), coarse (Ti, Nb) (C, N) is formed during heating or after a post weld heat treatment (PWHT), and thus, Nb is a factor which greatly deteriorates impact toughness at low temperature.

Therefore, Nb may be included at up to 0.01% when added. However, in the present disclosure, there is no difficulty in securing the targeted physical properties even in the case of not adding Nb.

Chromium (Cr): 0.2 to 1.5%

Chromium (Cr) is an element which greatly improves hardenability at the time of a thick steel plate to form martensite and is effective for securing strength. In order to sufficiently obtain the effect, Cr may be added at 0.2% or more. However, Cr greatly increases a carbon equivalent to adversely affect welding properties, and thus, the content may be limited to 1.5% or less.

Therefore, Cr may be included at 0.2 to 1.5%.

Nickel (Ni): 1.0 to 2.5%

Nickel (Ni) is an element which may improve both the strength and impact toughness at low temperature of a parent metal, and in order to sufficiently obtain the effect, Ni may be included at 1.0% or more. However, Ni is an expensive element, and when the content is more than 2.5%, economic feasibility is greatly deteriorated.

Therefore, Ni may be included at 1.0 to 2.5%, and more favorably at 2.3% or less.

Copper (Cu): 0.25% or Less (Including 0%)

Copper (Cu) is an element which minimizes a decrease in toughness of a parent metal and is favorable to improve strength. When the content of Cu is excessive, Cu increases carbon equivalent to deteriorate weldability and greatly degrades the surface quality of a product.

Therefore, Cu may be included at up to 0.25% when added. However, in the present disclosure, there is no difficulty in securing the targeted physical properties even in the case of not adding Cu.

Molybdenum (Mo): 0.25 to 0.80%

Molybdenum (Mo) greatly improves the hardenability of a steel to suppress ferrite formation, induces formation of bainite or martensite, and is favorable to greatly improve strength. In order to sufficiently obtain the effect, Mo may be added at 0.25% or more. However, Mo is an expensive element, and when added excessively, the hardness of a weld zone is excessively increased to deteriorate toughness, and thus, considering the fact, the content may be limited to 0.80% or less.

Therefore, Mo may be included at 0.25 to 0.80%.

Vanadium (V): 0.01 to 0.1%

Vanadium has a low solid solubilization temperature as compared with other alloy elements, and is precipitated in a weld heat affected zone at the time of welding to prevent a decrease in strength. When the strength is not sufficiently secured after welding and a post weld heat treatment (PWHT) of the ultra-thick steel plate as in the present disclosure, V may be added at 0.01% or more to obtain a strength improvement effect. However, when the content is more than 0.1%, a fraction of a hard phase such as a MA phase is increased to deteriorate the impact toughness at low temperature of a weld zone.

Therefore, V may be included at 0.01 to 0.1%.

Titanium (Ti): 0.003% or Less (Including 0%)

Titanium may be added in order to decrease occurrence of cracks on the surface by formation of an AlN precipitate in a steel. However, when the content is more than 0.003%, a coarse (Ti, Nb) (C, N) carbonitride is formed during a reheating or tempering heat treatment process of a steel slab to act as a factor to deteriorate impact toughness at low temperature.

Therefore, Ti may be limited to 0.003% or less, and in the present disclosure, there is no difficulty in securing the targeted physical properties even in the case of not adding Ti.

Boron (B): 0.001 to 0.003%

Boron (B) is an element which may improve hardenability of a steel with only a small amount of addition. In addition, B induces formation of a martensite phase, and thus, is favorable to secure the strength of a steel. In order to sufficiently obtain the effect, B may be included at 0.001% or more. However, when the content is more than 0.003%, the impact toughness at low temperature of a steel is rather greatly deteriorated.

Therefore, B may be included at 0.001 to 0.003%.

Nitrogen (N): 0.002 to 0.01%

Nitrogen (N) is an element which forms TiN when added with Ti, and is favorable to suppress crystal grain growth by heat affect at the time welding. In order to sufficiently obtain the effect when Ti is added, N may be included at 0.002% or more. However, when the content is more than 0.01%, coarse TiN is formed to deteriorate impact toughness at low temperature, which is thus not preferred.

Meanwhile, N may be contained in a steel even when Ti is not added, and when the content is within the range of 0.002 to 0.01%, there is no great difficulty in securing the targeted physical properties in the present disclosure.

The remaining component of the present disclosure is iron (Fe). However, since in the common manufacturing process, unintended impurities may be inevitably incorporated from raw materials or the surrounding environment, the component may not be excluded. Since these impurities are known to any person skilled in the common manufacturing process, the entire contents thereof are not particularly mentioned in the present specification.

It is preferred that the steel plate of the present disclosure having the alloy composition described satisfies a Ceq value represented by the following Relation 1 of more than 0.5 and less than 0.7.

$$Ceq=C+Mn/6+(Cr+Mo+V)/5+(Cu+Ni)/15 \quad \text{[Relation 1]}$$

In the present disclosure, in order to secure a target level of strength, in adding a certain amount of elements which are favorable to improve strength and improve hardenability, the contents of elements are appropriately controlled, so that excellent impact toughness at low temperature together with high strength is secured.

In particular, in the present disclosure, C, Mn, Cr, Mo, V, Cu, Ni, and the like are added to the steel, and when the contents thereof are excessive, a carbon equivalent (Ceq)

may be increased to raise a preheat temperature before welding or cause cracks. Therefore, it is preferred that the elements are added so that the contents thereof satisfies Relation 1.

In addition, among the alloy components described above, it is preferred that the component relationship among C, Mn, Cr, Mo, and V satisfies the following Relation 2, and the component relationship among Ti, Nb, Cu, Ni, and N satisfies the following Relation 3.

$$1.5<C+Mn+Cr+Mo+V<2.5 \quad \text{[Relation 2]}$$

$$[(Ti+Nb)/3.5N+(Cu/Ni)]<1 \quad \text{[Relation 3]}$$

wherein each element refers to a content by weight of the element.

When C, Mn, Cr, Mo, and V are included for securing the strength of a steel and their contents are excessive, a non-metallic inclusion such as MnS may be segregated in the thickness center portion of a steel plate, or a coarse MC carbide (wherein M is one or more of Cr, Mo, and V) may be precipitated to greatly deteriorate the impact toughness of the center portion.

Besides, when Ti and Nb are excessively added to the steel, coarse (Ti, Nb) (C, N) is formed to greatly impair impact toughness at low temperature, and also, when a content ratio between Cu and Ni is increased, surface cracks are caused.

Therefore, in the present disclosure, contents of specific elements of the alloy components are controlled by Relations 2 and 3, thereby improving the impact toughness at low temperature while securing the targeted high strength, and also improving resistance to crack occurrence.

The steel plate of the present disclosure satisfying Relations 1 to 3 together with the alloy components described above is an ultra-thick steel plate having a thickness of 130 mm or more and 350 mm or less.

The ultra-thick steel plate of the present disclosure may include a tempered martensite phase as a main phase as a microstructure, and a partly tempered bainite phase.

More specifically, the steel plate of the present disclosure may include the tempered martensite phase at an area fraction of 50% or more over the entire thickness. For example, the tempered martensite phase is included at an area fraction of 50% or more at a ½ t point and a ¼ t point (wherein t is the thickness (mm) of a steel plate) in a thickness direction of the steel plate, in which a fraction of 100% is possible.

When the fraction of the tempered martensite phase is less than 50%, a targeted level of strength may not be secured, and impact toughness may be deteriorated.

The steel plate of the present disclosure tends to have an increased fraction of the martensite phase from the center portion (for example, a ½ t point) to the surface layer part (for example, a ¼ t point~surface).

In addition, the steel plate is formed so that a maximum diameter of a MnS inclusion is 100 μm or less in the center portion of the thickness, for example, near a ½ t point in the thickness direction (wherein t is a thickness (mm) of the steel plate), preferably within 5 mm in the upper/lower portion based on a ½ t point in the thickness direction, thereby preventing deterioration of the impact toughness by a coarse inclusion.

The steel plate of the present disclosure having the microstructure described above has a yield strength of 690 MPa or more, a tensile strength of 750 MPa or more, and a Charpy impact absorption energy (CVN) value at −40° C. of 50 J or more on average over the entire thickness, for example, at a ½ t point and ¼ t point in the thickness direction of the steel plate (wherein t is the thickness (mm) of the steel plate) and thus, may have excellent impact toughness at low temperature together with high strength.

In addition, the steel plate of the present disclosure has an impact absorption energy value of 30 J or more, more favorably 40 J or more on average, when an impact test at −40° C. is performed after being subjected to a 5% strain and an aging heat treatment, and thus, the impact toughness at low temperature of the steel plate is not greatly decreased at the time of strain aging.

The aging heat treatment is not particularly limited, but for example, may be performed under the conditions of a heat treatment at 250° C. for 1 hour after a 5% strain.

Meanwhile, the steel plate for use in large structures is welded for structure manufacture, and thus, is required to have excellent weldability.

The steel plate of the present disclosure has excellent impact toughness at low temperature in a weld heat affected zone (HAZ) formed after welding, and specifically, it is preferred to secure a Charpy impact absorption energy value of 30 J or more, more favorably 40 J or more on average, when performing an impact test in a rolling direction at 40° C.

Hereinafter, a method for manufacturing a high-strength ultra-thick steel plate having excellent impact toughness at low temperature as another aspect of the present disclosure will be described in detail.

The ultra-thick steel plate according to the present disclosure may be manufactured by subjecting the steel slab satisfying all of the alloy components and the component relations suggested in the present disclosure to [heating-hot-rolling-cooling-reheating-cooling-tempering] processes.

Hereinafter, each process conditions will be described in detail.

[Steel Slab Heating]

In the present disclosure, it is preferred that a steel slab is heated before performing hot rolling to perform a homogenization treatment, in which the heating process may be performed at a temperature within a range of 1100 to 1200° C.

When the heating temperature of the steel slab is lower than 1100° C., precipitates (carbide, nitride) formed in the slab are not sufficiently resolubilized to decrease formation of the precipitates in the process after the hot rolling. However, when the temperature is higher than 1200° C., an austenite crystal grain is coarsened to deteriorate the physical properties of the steel.

The steel slab may be a continuous cast slab obtained by continuous casting, and the continuous cast slab may be heated as it is, or may be forged before heating to obtain a forged slab and then subjected to the heating process.

Specifically, before the heating, heating the continuous cast slab to a temperature equivalent to or higher than Ac3, and then forging the slab to a thickness of 10 to 50% of the initial thickness of the continuous cast slab, may be further included.

The present disclosure is intended to finally obtain a thick steel sheet having a thickness of 130 mm or more, and in order to obtain a steel sheet having a targeted thickness within a limited pressing ratio (3:1) at the time of hot rolling, it is necessary to apply a slab having a thickness of 400 mm or more.

As described above, in the present disclosure, a continuous slab obtained by continuous casting may be used, and when the thickness of the continuous cast slab is about 600 to 700 mm herein, a forging process may be performed before heating the slab to decrease the thickness. In particular, when the forging process is performed, the internal pores of the slab are minimized while the thickness is effectively decreased, and a sufficient pressing force may be applied in a subsequent process (hot rolling process).

[Hot Rolling]

The steel slab heated according to the above is hot rolled to be manufactured into a hot rolled steel sheet. Here, the heated steel slab may be roughly rolled at a temperature of 1050° C. or higher and then finish rolled at a temperature equivalent to or higher than Ar3.

At the time of the rough rolling, when the temperature is lower than 1050° C., the temperature is lowered in the subsequent finish hot rolling. In addition, when the temperature is lower than Ar3 in the finish hot rolling, a rolling load may be increased to cause poor quality such as surface cracks.

More favorably, the finish hot rolling may be performed at a temperature within a range of 800 to 1050° C.

In the present disclosure Ar3 may be represented as follows:

$$Ar3=910-310C-80Mn-20Cu-55Ni-80Mo+119V+124Ti-18Nb+179Al$$ (wherein each element refers to a content by weight of the element.)

[Cooling and Reheating]

It is preferred that the hot rolled steel sheet manufactured according to the above is air cooled to room temperature, and then reheated to a temperature equivalent to or higher than Ac3 and maintained for a certain period of time.

In the present disclosure, production of a fine austenite structure is promoted by the reheating process, and a low-temperature transformation phase may be formed in the subsequent cooling.

That is, the hot rolled steel sheet may be reheated to form an austenite structure, but when the reheating temperature is lower than Ac3, the hot rolled steel sheet structure may be a two-phase structure of ferrite and austenite.

Therefore, the reheating of the hot rolled steel sheet is performed at a temperature equivalent to or higher than Ac3, preferably at a temperature within a range of 830 to 930° C., and it is preferred that the temperature is maintained for (1.9 t+30) minutes (wherein t is the thickness (mm) of the steel) so that 100% of the austenite phase is sufficiently formed in the center portion of the hot rolled steel sheet.

In the present disclosure, Ac3 may be represented as follows:

$$Ac3=937.2-436.5C+56Si-19.7Mn-26.6Ni+38.1Mo+124.8V+136.3Ti-19.1Nb+198.4Al$$ (wherein each element refers to a content by weight of the element.)

[Cooling and Tempering Heat Treatment]

After the reheated hot rolled steel sheet is cooled to room temperature according to the above, a tempering heat treatment process may be performed for forming a tempered structure.

The cooling may be water cooling for forming a low-temperature structure phase well, at a cooling rate of 0.5° C./s or more. Here, the cooling rate is based on a ¼ t area in the thickness of the hot rolled steel sheet.

When the cooling rate is less than 0.5° C./s in the water cooling, a soft phase such as a ferrite phase may be formed during the cooling. Since a higher cooling rate is favorable to formation of a low-temperature structure in the water cooling, the upper limit is not particularly limited. However, cooling may be performed at a cooling rate up to 100° C./s, considering cooling equipment.

The water cooled hot rolled steel sheet may include a low-temperature structure phase, preferably a martensite or bainite phase as the microstructure. When the low-temperature structure phase is included as such, the steel sheet may have high strength, but shows brittle properties.

In the present disclosure, the hot rolled steel sheet having a low-temperature structure phase formed is heated to a certain temperature and then maintained, thereby slightly lowering the strength of the steel and securing the impact toughness at low temperature.

Specifically, the hot rolled steel sheet is subjected to a tempering heat treatment at a temperature within a range of 550 to 700° C. for (2.3 t+30) minutes or more (wherein t is the thickness (mm) of the steel), thereby forming a tempered martensite or tempered bainite phase.

When the temperature is lower than 550° C. in the temperature heat treatment, a heat treatment for a long time is needed to sufficiently secure the tempering heat treatment effect, thereby deteriorating economic feasibility. However, when the temperature is higher than 700° C., a strength lowering effect is unduly large, and a carbide is coarsened to deteriorate impact toughness also. In addition, in the tempering heat treatment in the above temperature range, when the time is less than (2.3 t+30) minutes, a tempering effect is not sufficient.

The hot rolled steel sheet completing the tempering heat treatment is air cooled to room temperature, from which a steel plate formed of a tempered martensite phase at an area fraction of 50% or more and a residual tempered bainite phase as a microstructure may be obtained.

The steel plate of the present disclosure is an ultra-thick steel plate having a thickness of 130 mm or more and 350 mm or less, and has a uniform structure in the thickness of the steel, thereby having excellent impact toughness at low temperature and excellent resistance to crack occurrence together with high strength.

Furthermore, welding the ultra-thick steel plate of the present disclosure, that is, the air cooled hot rolled steel sheet may be further included, in which the welding may be performed by submerged arc welding (SAW) or flux cored arc welding (FCAW). As an example, the submerged arc welding may be performed under common conditions, for example, with a heat input quantity of 5.0 kJ/cm. In addition, the flux cored arc welding may be also performed under common conditions, for example, with a heat input quantity of 1.5 kJ/cm.

The ultra-thick steel plate of the present disclosure may have excellent impact toughness at low temperature even after welding.

Hereinafter, the present disclosure will be specifically described through the following Examples. However, it should be noted that the following Examples are only for describing the present disclosure in detail by illustration, and are not intended to limit the right scope of the present disclosure. The reason is that the right scope of the present disclosure is determined by the matters described in the claims and reasonably inferred therefrom.

MODE FOR INVENTION

Examples

A molten steel having the alloy composition shown in Table 1 was continuously cast to manufacture a continuous cast slab. Here, the continuous cast slab was manufactured to have a thickness of 700 mm. The continuous cast slab was heated to a temperature equivalent to or higher than Ac3, so as to be subjected to a subsequent hot rolling process, and was forged to a thickness of 400 mm to manufacture a forged slab.

The forged slab was heated to 1100° C., roughly rolled, and subjected to finish hot rolling at 850° C. to obtain a hot rolled steel sheet having a thickness of 210 mm. The hot rolled steel sheet was air cooled to room temperature, reheated to 910° C. and maintained, and water cooled to room temperature again.

Thereafter, the water cooled hot rolled steel sheet was heated to 650° C. and maintained to perform a tempering heat treatment, and then air cooled to room temperature to manufacture a final steel plate. Exceptionally, Steel 9 was heated to 720° C. in the tempering heat treatment and maintained, and then air cooled to room temperature.

At this time, the steel was maintained for 513 minutes at the reheating temperature, and maintained for 744 minutes at the tempering heat treatment temperature. In addition, the water cooling was performed at a cooling rate of 0.6° C./s based on a center portion (½ t area) of each steel plate.

TABLE 1

| | Alloy composition (wt %) | | | | | | | | | | | | | | |
|---|---|---|---|---|---|---|---|---|---|---|---|---|---|---|---|
| Steel type | C | Si | Mn | P | S | Al | Nb | Cr | Ni | Cu | Mo | V | Ti | B | N |
| 1 | 0.145 | 0.20 | 0.45 | 0.008 | 0.002 | 0.065 | 0 | 1.05 | 2.1 | 0 | 0.56 | 0.03 | 0 | 0.002 | 0.0035 |
| 2 | 0.140 | 0.21 | 0.55 | 0.008 | 0.002 | 0.065 | 0 | 1.00 | 2.1 | 0 | 0.56 | 0.03 | 0 | 0.002 | 0.0035 |
| 3 | 0.135 | 0.20 | 1.10 | 0.008 | 0.002 | 0.065 | 0 | 0.55 | 2.1 | 0 | 0.60 | 0.03 | 0 | 0.002 | 0.0035 |
| 4 | 0.126 | 0.20 | 0.75 | 0.008 | 0.002 | 0.063 | 0 | 0.75 | 2.1 | 0.15 | 0.56 | 0.03 | 0 | 0.002 | 0.0035 |
| 5 | 0.110 | 0.20 | 1.65 | 0.008 | 0.002 | 0.065 | 0 | 0.10 | 2.3 | 0 | 0.60 | 0.03 | 0 | 0.002 | 0.0035 |
| 6 | 0.110 | 0.20 | 1.65 | 0.008 | 0.002 | 0.065 | 0 | 0.30 | 2.3 | 0 | 0.60 | 0.03 | 0.013 | 0.002 | 0.0035 |
| 7 | 0.110 | 0.20 | 1.65 | 0.008 | 0.002 | 0.065 | 0.015 | 0.30 | 2.3 | 0 | 0.60 | 0.03 | 0.013 | 0.002 | 0.0035 |
| 8 | 0.130 | 0.22 | 1.10 | 0.008 | 0.002 | 0.065 | 0 | 1.05 | 2.1 | 0.1 | 0.56 | 0.03 | 0 | 0.002 | 0.0035 |
| 9 | 0.132 | 0.21 | 0.45 | 0.008 | 0.002 | 0.065 | 0 | 1.05 | 2.1 | 0.1 | 0.56 | 0.03 | 0.002 | 0.002 | 0.0035 |

TABLE 2

| Steel | Component relation | | |
|---|---|---|---|
| type | Relation 1 (Ceq) | Relation 2 | Relation 3 |
| 1 | 0.688 | 2.24 | 0 |
| 2 | 0.690 | 2.28 | 0 |
| 3 | 0.694 | 2.42 | 0 |
| 4 | 0.669 | 2.22 | 0.07 |
| 5 | 0.684 | 2.49 | 0 |
| 6 | 0.724 | 2.69 | 1.06 |
| 7 | 0.724 | 2.69 | 2.29 |
| 8 | 0.788 | 2.87 | 0.05 |
| 9 | 0.682 | 2.22 | 0.21 |

Thereafter, the microstructure of each steel plate was observed and the mechanical properties thereof were evaluated. The microstructure was observed by an optical microscope, a tempered martensite (T-M) phase and a tempered bainite (T-B) phase were visually distinguished using EBSD equipment, and each fraction was measured. At this time, the microstructure was measured at a ½ t point and ¼ t point in the thickness direction of each steel plate, respectively, and the results are shown in Table 3. In addition, the size of a MnS inclusion (circle-equivalent diameter) formed in a 5 mm area in the upper/lower portion based on a ½ t point in the thickness direction of each steel plate was observed, and the maximum value is shown in Table 3.

Further, mechanical properties at ½ t point and ¼ t point in the thickness direction of each steel plate were measured, and at this time, a tensile specimen of JIS No. 1 standard was collected at each point of in the thickness direction in the direction perpendicular to a rolling direction and a tensile strength (TS), a yield strength (YS), and an elongation (EI) were measured, a specimen of JIS No. 4 standard was collected at each point in the thickness direction in a rolling direction as an impact specimen to measure an impact toughness (CVN) at −40° C., and the results are shown in Table 4. The impact test was performed three times at each point, and the average value and the individual value are all shown.

TABLE 3

| | Microstructure | | | | MnS diameter | |
|---|---|---|---|---|---|---|
| | ¼t | | ½t | | (μm) | |
| Steel type | T-M | T-B | T-M | T-B | Maximum value | Remarks |
| 1 | 64 | 36 | 54 | 46 | 31 | Inventive Example 1 |
| 2 | 59 | 41 | 52 | 48 | 45 | Inventive Example 2 |
| 3 | 52 | 48 | 52 | 48 | 94 | Inventive Example 3 |
| 4 | 57 | 43 | 54 | 46 | 64 | Inventive Example 4 |
| 5 | 45 | 55 | 38 | 62 | 157 | Comparative Example 1 |
| 6 | 62 | 38 | 58 | 42 | 149 | Comparative Example 2 |
| 7 | 61 | 39 | 53 | 47 | 162 | Comparative Example 3 |
| 8 | 62 | 38 | 51 | 49 | 122 | Comparative Example 4 |
| 9 | 61 | 39 | 56 | 44 | 88 | Comparative Example 5 |

TABLE 4

| | ¼t | | | | | | ½t | | | | | |
|---|---|---|---|---|---|---|---|---|---|---|---|---|
| | Tensile properties | | | | CVN (−40° C.) | | Tensile properties | | | | CVN (−40° C.) | |
| Steel type | YS (MPa) | TS (MPa) | El (%) | YR | Average (J) | Individual value (J) | YS (MPa) | TS (MPa) | El (%) | YR | Average (J) | Individual value (J) |
| Inventive Example 1 | 767 | 858 | 20 | 89 | 189 | 184-197 | 757 | 850 | 20 | 89 | 153 | 132-174 |
| Inventive Example 2 | 755 | 833 | 21 | 91 | 178 | 165-194 | 745 | 826 | 20 | 90 | 149 | 122-169 |
| Inventive Example 3 | 814 | 875 | 20 | 93 | 102 | 90-112 | 798 | 869 | 20 | 92 | 95 | 85-102 |
| Inventive Example 4 | 742 | 813 | 20 | 91 | 114 | 86-133 | 736 | 816 | 21 | 90 | 92 | 83-107 |

TABLE 4-continued

| | ¼t | | | | | | ½t | | | | | |
|---|---|---|---|---|---|---|---|---|---|---|---|---|
| | Tensile properties | | | | CVN (−40° C.) | | Tensile properties | | | | CVN (−40° C.) | |
| Steel type | YS (MPa) | TS (MPa) | El (%) | YR | Average (J) | Individual value (J) | YS (MPa) | TS (MPa) | El (%) | YR | Average (J) | Individual value (J) |
| Comparative Example 1 | 827 | 907 | 21 | 91 | 38 | 36-39 | 829 | 897 | 20 | 92 | 44 | 40-48 |
| Comparative Example 2 | 800 | 880 | 20 | 91 | 42 | 37-48 | 802 | 879 | 16 | 91 | 54 | 46-59 |
| Comparative Example 3 | 843 | 919 | 20 | 92 | 25 | 18-29 | 838 | 913 | 19 | 92 | 31 | 26-39 |
| Comparative Example 4 | 754 | 838 | 21 | 90 | 90 | 87-92 | 746 | 835 | 22 | 89 | 49 | 34-78 |
| Comparative Example 5 | 644 | 732 | 24 | 88 | 47 | 25-62 | 640 | 736 | 23 | 87 | 36 | 17-55 |

As shown in Tables 3 and 4, it is confirmed that Inventive Examples 1 to 4 which were manufactured by the alloy composition, the component relationship, and the manufacturing conditions suggested in the present disclosure formed the intended structure in the thickness direction to have high strength and excellent impact toughness at low temperature.

However, it is confirmed that Comparative Examples 1 to 4 which did not satisfy the alloy composition or the component relationship suggested in the present disclosure had very poor impact toughness at low temperature.

Among these, Comparative Example 1 in which the content of Cr was insufficient had greatly decreased hardenability, and thus, had poor impact toughness at low temperature. In addition, in Comparative Examples 2 and 3 in which Ti was excessively included, TiN or (Ti, Nb) (C, N) precipitates formed in the steel cause crack propagation and a coarse MnS inclusion was formed in the center portion, and thus, impact toughness was very poor.

Comparative Example 4 was the case in which the alloy composition suggested in the present disclosure was satisfied, but Relation 1 was out of the present disclosure, and it is confirmed that a tensile strength similar to Comparative Examples 1 to 3 was shown, but impact toughness in the center portion was poor.

In addition, Comparative Example 5 satisfied the alloy design of the present disclosure, but had an excessively high temperature at the time of the tempering heat treatment. In Comparative Example 5 as such, since a dislocation accumulated inside the steel after a reheating and cooling process (quenching process) was annealed during the tempering heat treatment, a softening degree was increased with increasing temperature, and a carbide precipitated inside was also coarsened with increasing temperature, and the, the strength and the impact toughness were very poor.

Meanwhile, a strain aging heat treatment for each of the above steel plates was performed, and then an impact specimen was collected at a ¼ t point in the thickness direction and impact toughness (CVN) was measured at −40° C., and the results are shown in Table 5. At this time, the strain aging heat treatment was performed by performing strain at 5% and then an aging heat treatment at 250° C. for 1 hour.

In addition, each steel plate was subjected to flux cored arc welding at a heat input of 1.5 kJ/cm, an impact specimen was collected in the weld heat affected zone, an impact toughness (CVN) was measured at −40° C., and the results are illustrated in Table 5.

Each of the impact tests was performed three times at each point, and the average value and the individual value are all shown.

TABLE 5

| | After strain aging heat treatment (−40° C., J) | | After welding (−40° C., J) | |
|---|---|---|---|---|
| Steel type | Average value | Individual value | Average value | Individual value |
| Inventive Example 1 | 126 | 89-154 | 113 | 76-134 |
| Inventive Example 2 | 119 | 84-146 | 107 | 61-132 |
| Inventive Example 3 | 68 | 52-83 | 61 | 53-72 |
| Inventive Example 4 | 72 | 60-88 | 66 | 55-74 |
| Comparative Example 1 | 25 | 12-35 | 23 | 15-29 |
| Comparative Example 2 | 28 | 13-36 | 25 | 14-32 |
| Comparative Example 3 | 17 | 11-32 | 15 | 13-19 |
| Comparative Example 4 | 60 | 46-84 | 48 | 36-62 |
| Comparative Example 5 | 27 | 21-42 | 32 | 21-45 |

As shown in Table 5, it was found that Inventive Examples 1 to 4 according to the present disclosure had excellent impact toughness at low temperature after the strain aging heat treatment, and also did not have reduced impact toughness of the weld heat affected zone after the welding.

However, in Comparative Examples 1 to 3 and Comparative Example 5, it was confirmed that the impact toughness at low temperature of a parent metal was greatly reduced after the strain aging heat treatment, and the impact toughness of the weld heat affected zone was also greatly decreased. In Comparative Example 4, the impact toughness at low temperature of the parent metal before the strain aging heat treatment was good, but it was found that the impact toughness at low temperature was reduced after the strain aging heat treatment, and in particular, the impact toughness of the weld heat affected zone was greatly reduced after welding.

FIG. 1 shows the results after performing an impact test at 0° C., −20° C., −40° C., and −60° C. for the steel plates of Inventive Example 1 and Comparative Examples 1 and 4.

At this time, the impact specimen was collected at a ¼ t point in the thickness direction in the same manner as described above.

As shown in FIG. 1, Inventive Example 1 had an impact toughness measured as 150 J or more even at a cryogenic temperature of −60° C., but Comparative Examples 1 and 4 showed a tendency of greatly decreasing impact toughness with decreasing temperature.

The invention claimed is:

1. A high-strength ultra-thick steel plate having excellent impact toughness at low temperature comprising, by weight: 0.11 to 0.18% of carbon (C), 0.1 to 0.5% of silicon (Si), 0.3 to 1.8% of manganese (Mn), 0.01% or less of phosphorus (P), 0.01% or less of sulfur (S), 0.01 to 0.1% of aluminum (Al), 0.01% or less (including 0%) of niobium (Nb), 0.2 to 1.5% of chromium (Cr), 1.0 to 2.5% of nickel (Ni), 0.25% or less (including 0%) of copper (Cu), 0.25 to 0.80% of molybdenum (Mo), 0.01 to 0.1% of vanadium (V), 0.003% or less (including 0%) of titanium (Ti), 0.001 to 0.003% of boron (B), and 0.002 to 0.01% of nitrogen (N), with a balance of Fe and unavoidable impurities, wherein a Ceq value represented by the following Relation 1 is more than 0.5 and less than 0.7, a component relationship among C, Mn, Cr, Mo, and V satisfies the following Relation 2, a component relationship among Ti, Nb, Cu, Ni, and N satisfies the following Relation 3, and the steel plate has a thickness of 130 mm or more and 350 mm or less:

$$Ceq=C+Mn/6+(Cr+Mo+V)/5+(Cu+Ni)/15 \quad \text{[Relation 1]}$$

$$1.5<C+Mn+Cr+Mo+V<2.5 \quad \text{[Relation 2]}$$

$$[(Ti+Nb)/3.5N+(Cu/Ni)]<1 \quad \text{[Relation 3]}$$

wherein each element refers to a content by weight of the element, and wherein a MnS inclusion has a maximum diameter of 100 μm or less in a center portion of the thickness of the steel plate.

2. The high-strength ultra-thick steel plate having excellent impact toughness at low temperature of claim 1, wherein the steel plate includes tempered martensite at an area fraction of 50% or more and a residual tempered bainite phase.

3. The high-strength ultra-thick steel plate having excellent impact toughness at low temperature of claim 1, wherein the steel plate has a yield strength of 690 MPa or more, a tensile strength of 750 MPa or more, and a Charpy impact absorption energy value at −40° C. of 50 J or more on average.

4. The high-strength ultra-thick steel plate having excellent impact toughness at low temperature of claim 1, wherein when an impact test at −40° C. is performed on the steel plate after a 5% strain and an aging heat treatment, the steel plate has an impact absorption energy value of 30 J or more on average.

5. The high-strength ultra-thick steel plate having excellent impact toughness at low temperature of claim 1, wherein the steel plate has a Charpy impact absorption energy value at −40° C. of 30 J or more on average in a weld heat affected zone (HAZ) formed after welding.

* * * * *